United States Patent [19]

Yeamans

[11] Patent Number: 4,926,596

[45] Date of Patent: May 22, 1990

[54] ROOF DECK COVERING SYSTEM

[76] Inventor: Robert C. Yeamans, 2777 Northwest Blvd., Columbus, Ohio 43221

[21] Appl. No.: 294,023

[22] Filed: Jan. 6, 1989

[51] Int. Cl.[5] ..... E04B 7/00

[52] U.S. Cl. ..... 52/408

[58] Field of Search ..... 52/22, 408, 410, 2, 52/404, 262, 3

[56] References Cited

U.S. PATENT DOCUMENTS

| | | | |
|---|---|---|---|
| 3,706,206 | 12/1972 | Clark | 52/2 P |
| 3,769,763 | 11/1973 | Kwake | 52/2 P |
| 4,045,922 | 9/1977 | Elliott | 52/408 |
| 4,188,756 | 2/1980 | Ljungbo | 52/2 P |
| 4,574,544 | 3/1986 | Harris | 52/23 |
| 4,674,249 | 6/1987 | Bennett | 52/408 |
| 4,736,562 | 4/1988 | Kelley | 52/410 |

*Primary Examiner*—John E. Murtagh

*Attorney, Agent, or Firm*—John L. Gray

[57] ABSTRACT

A roof waterproofing membrane positioned on a roof deck and secured at the periphery thereof and covered by an apertured overlay having openings therein which is also secured at the periphery of the roof deck surface.

4 Claims, 1 Drawing Sheet

ROOF DECK COVERING SYSTEM

BACKGROUND OF INVENTION

Roof membranes usually made of an elastomeric single sheet material are increasingly being used for commercial and industrial flat roof installations. There is a continuing problem with such waterproofing membrane systems in that they become disengaged or damaged as the result of wind uplift forces, a condition associated with changes in atmospheric pressure.

In order to prevent this from happening, a variety of methods are used to prevent the membrane from being disturbed by wind uplift forces. One of the common ones is the use of stone ballast. In such a method the waterproofing membrane is completely covered with stone ballast aggregate (usually ¾" to 2 ½" in size), at the rate of approximately 10 pounds per square foot. This has the potential disadvantage of exceeding the design dead-load of the structure, thus restricting the live-load capacity of existing roof decks and supporting structure. Also, due to wind movement, the stone ballast can shift. The ballast thus fails to perform satisfactorily and permits the membrane to billow causing, in some instances, stone to be ejected from the rooftop, resulting in potential damage or injury to property or persons and ultimately resulting in the waterproofing membrane becoming damaged or disengaged.

Another system involves mechanical affixing the waterproofing membrane and subcomponents thereunder with threaded fasteners throughout the field of the roof in a predetermined pattern. Approximately 65 percent of commercial and industrial buildings utilize steel decks. When threaded fasteners are used to secure the waterproofing membrane and subcomponents to the steel decks, they experience lateral as well is vertical loads induced by wind uplift forces. Since the steel decks are usually 18 to 20 gauge in thickness, they offer a minimum of net area for thread engagement. Membrane billowing and steel deck flutter are typical effects of wind uplift forces. This causes threaded fasteners to become disengaged, ultimately backing out and leaving the membrane unsecured. When fasteners back out from steel decks, they frequently cause puncturing of the waterproofing membrane when the roof is subjected to live loads. Further, corrosion of the threaded fasteners and/or the structural steel deck results. Even with the use of noncorrosive threaded fasteners, corrosion occurs at the steel deck around the thread engagement of the fastener due to thermal conductance and an associated dew point. This not only results in the failure of the waterproofing membrane securement system, but also in structural damage to the steel deck.

Another securement system used is fully to adhere the waterproofing membrane with an adhesive to the top surface of a subcomponent which has been mechanically affixed to the roof deck. This method of roof membrane securement to a subcomponent has inherent disadvantages. Membrane subcomponents must first be mechanically affixed to the structural deck by means of threaded fasteners. Subcomponent materials, such as insulating materials, are frequently sensitive to moisture and condensation, permitting separation of subcomponent top surface at the interface of the adhesive bond. The adhesive bond between waterproofing membrane and subcomponent top surface is subjected to shear forces as a result of expansion and contraction of the membrane. The adhesives are extremely sensitive to moisture and temperature. The adhesive bond failure at the interface of the subcomponent and the waterproofing membrane results in the loss of membrane securement.

Another system involves the use of ballast boards. In this system, the waterproofing membrane is restrained with a ballast board of extruded closed cell polystyrene insulation having tongue and groove sides and a cementitious mortar topping. The total weight is approximately 4.5 pounds per square foot. This weight, in some cases, exceeds the design dead-load. Consequently, it restricts live-load capacity of existing roof decks. The membrane subcomponents must first be mechanically affixed to the structural deck by means of threaded fasteners with all subcomponent joints taped. The tongue and groove integrity of ballast boards is paramount in providing wind uplift resistance. Extensive metal strapping or concrete slabs, sometimes referred to as pavers, are required to secure the ballast board around the perimeter of roof and where tongue and groove integrity has been interrupted. Should the membrane billow, loose or disengaged ballast boards can be ejected from the roof, causing personal injury and property damage. In addition, the waterproofing membrane can then become damaged or disengaged.

SUMMARY OF THE INVENTION

The roof construction system holding roof weatherproof membranes in place, which is the subject matter of the present invention, avoids the various disadvantages recited above. It involves the use of a prefabricated apertured overlay which is placed over the waterproofing membrane and is secured at the perimeter of the roof. The apertured overlay is made of a material having significantly less elongation than the waterproofing membrane. The apertured overlay which is secured at its perimeter as is the waterproofing membrane, restricts membrane billowing as a result of wind-uplift forces, a condition associated with changes in atmospheric pressure.

The instant invention is extremely lightweight and thus does not restrict roof deck live-loads. The openings in the apertured overlay allow wind passage while restricting the billowing of the waterproofing membrane. The wind uplift forces on the waterproofing membrane are equally distributed and restrained because the apertured overlay is secured around the periphery of the roof. The use of this roof construction system does not restrict either the elongation of the waterproofing membrane as the result of temperature differential, nor does it restrict drainage. The apertured overlay cannot become a hazardous projectile, as is the case with ballast securement systems that are in use today.

It is therefore an object of this invention to provide a roof construction system for holding a roof waterproofing membrane in place on a flat roof, which permits the use of a loosely laid membrane material and prevents the membrane material from billowing as a result of wind uplift forces, a condition associated with changes in atmospheric pressure.

It is a further object of this invention to provide such a roof construction system which involves the use of an apertured overlay.

These, together with other objects and advantages of the invention will become more readily apparent to those skilled in the art when the following general statements and descriptions are read in the light of the appended drawings.

DETAILED DESCRIPTION OF THE INVENTION

Figure 1:
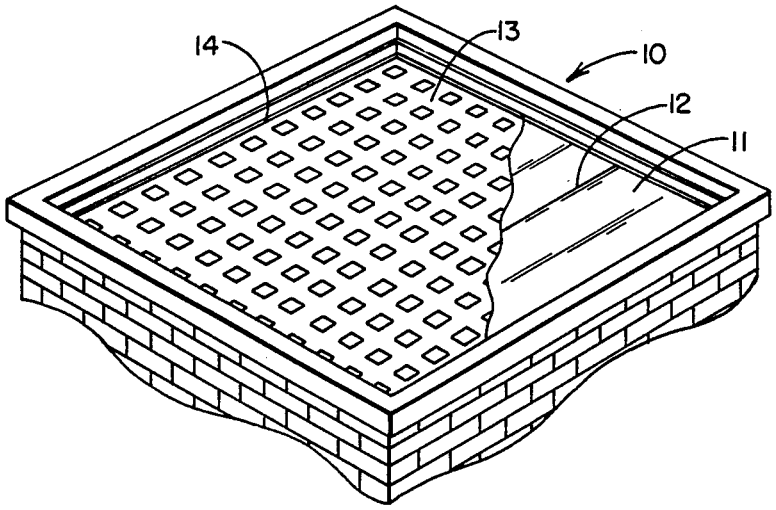
FIG. 1 is a perspective view of the roof construction system of applicant with a portion of the apertured overlay cut away to show the membrane thereunder.

Applicant's invention is shown on a flat roof deck 10 wherein a conventional elastomeric single sheet membrane 11 has been installed with and adhesively connected seam 12. The apertured overlay 13 has been placed over the membrane 11 and both are secured at the periphery 14 of the roof by any suitable means. A preferred securement system is shown in applicant's copending patent application, Ser. No. 07/294,038.

Figure 2:
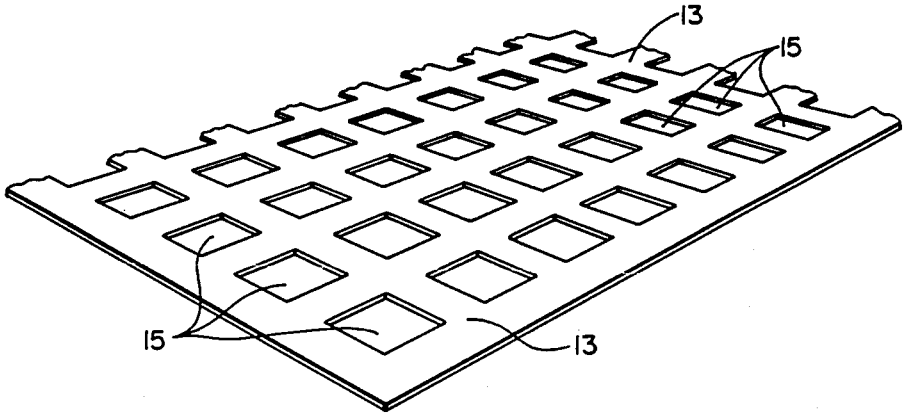
FIG. 2 is a perspective view of a typical apertured overlay constituting a portion of applicant's invention.

Referring now more particularly to FIG. 2, there is shown one version of applicant's apertured overlay 13 with regularly spaced apertures 15—15 therein. The apertured overlay 13 preferably does not have apertures 15—15 adjacent the edge thereof in order to enable the apertured overlay 13 to be held more securely at the periphery of the roof 14. The apertured overlay 13 is manufactured from ultraviolet stable materials. Some materials which are satisfactory are rubber, plastic, and metal. While the apertured overlay 13 as shown in FIGS. 1 and 2 is fabricated with square openings, the apertured overlay 13 can take the form of a netting, webbing, or grid pattern of geometric shapes with required strength. The apertured overlay 13 is made of a material that does not have as much elongation as the waterproofing membrane 11 so that it will resist billowing of the membrane 11 when wind-uplift forces, a condition associated with changes in atmospheric pressure, come into play. The apertured overlay 13 can be fabricated into geometrical configurations, shapes, or patterns of rods, tubes, strips, strands, fibers, or braided, woven or nonwoven fabrics.

While this invention has been described in its preferred embodiment, it is to be appreciated that variations therefrom may be made without departing from the true scope and spirit of the invention.

What is claimed is:

1. A system for covering a roof deck comprising, a roof waterproofing membrane positioned on said roof deck and secured at the periphery of said roof deck, a flat sheet apertured overlay positioned on top of said membrane immediately adjacent thereto and in contact therewith and secured at the periphery of said roof deck, said apertured overlay being provided with a plurality of apertures therein and being made of a material having significantly less elongation than said membrane.

2. The system of claim 1 wherein said apertures in said apertured overlay are in equi-spaced patterns.

3. The system of claim 1 wherein said apertured overlay does not have apertures in the periphery thereof.

4. The system of claim 1 wherein said apertured overlay is made from an ultraviolet stable material.

* * * * *

UNITED STATES PATENT AND TRADEMARK OFFICE

CERTIFICATE OF CORRECTION

PATENT NO. : 4,926,596

DATED : May 22, 1990

INVENTOR(S) : Robert C. Yeamans

It is certified that error appears in the above-identified patent and that said Letters Patent is hereby corrected as shown below:

Column 1, line 36, change "is" to "as".

Column 3, line 15, change "and" to "an".

Signed and Sealed this

Twenty-eighth Day of May, 1991

*Attest:*

*Attesting Officer*

HARRY F. MANBECK, JR.

*Commissioner of Patents and Trademarks*